US009527112B2

(12) United States Patent
Brulefert

(10) Patent No.: US 9,527,112 B2
(45) Date of Patent: Dec. 27, 2016

(54) DYNAMIC SEPARATOR FOR PULVERULENT MATERIALS

(75) Inventor: Michel Brulefert, Asnieres sur Seine (FR)

(73) Assignee: PA TECHNOLOGIES, Thionville (FR)

( * ) Notice: Subject to any disclaimer, the term of this patent is extended or adjusted under 35 U.S.C. 154(b) by 241 days.

(21) Appl. No.: 14/124,917

(22) PCT Filed: May 29, 2012

(86) PCT No.: PCT/FR2012/051194
§ 371 (c)(1),
(2), (4) Date: Mar. 5, 2014

(87) PCT Pub. No.: WO2012/168625
PCT Pub. Date: Dec. 13, 2012

(65) Prior Publication Data

US 2014/0166554 A1 Jun. 19, 2014

(30) Foreign Application Priority Data

Jun. 8, 2011 (FR) ..... 11 55000

(51) Int. Cl.
*B04B 5/10* (2006.01)
*B07B 7/083* (2006.01)
*B07B 4/06* (2006.01)
*B07B 7/08* (2006.01)

(52) U.S. Cl.
CPC ..... *B07B 7/083* (2013.01); *B07B 4/06* (2013.01); *B07B 7/08* (2013.01)

(58) Field of Classification Search
CPC ..... B07B 4/04; B07B 4/025; B07B 7/08; B07B 7/083; B07B 11/06
USPC ..... 209/135, 154, 710, 714
See application file for complete search history.

(56) References Cited

U.S. PATENT DOCUMENTS 4,799,595 A * 1/1989 Binder ..... B07B 7/083 209/135
5,158,182 A * 10/1992 Fischer-Helwig ..... B07B 7/083 209/135
2009/0065403 A1* 3/2009 Ito ..... B07B 7/083 209/139.2
2011/0132813 A1* 6/2011 Baetz ..... B04C 5/12 209/138
2012/0318042 A1* 12/2012 Kozawa ..... B07B 4/02 73/28.01

* cited by examiner

*Primary Examiner* — Joseph C Rodriguez
*Assistant Examiner* — Kalyanavenkateshware Kumar
(74) *Attorney, Agent, or Firm* — Egbert Law Offices, PLLC

(57) ABSTRACT

A dynamic separator for pulverulent materials, such as cement, lime or raw materials, comprising: a primary rotor which can rotate about a vertical axis and is provided with primary selection blades arranged about its periphery in such a way as to sweep a hollow circular cylinder during the rotation of the primary rotor, a secondary rotor provided with secondary selection blades arranged around its periphery, and guide valves located on the outside of the aforementioned cylinder such as to form a primary selection chamber between the guide valves and the primary selection blades. At least part of the secondary selection blades is located inside the cylinder, such as to form a secondary selection chamber between the primary selection blades and the secondary selection blades. A separation method using a separator is also disclosed.

12 Claims, 3 Drawing Sheets

DYNAMIC SEPARATOR FOR PULVERULENT MATERIALS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to the classification of powders of varying particle sizes, in a dynamic separator through which a gaseous stream, generally air, passes.

2. Description of Related Art Including Information Disclosed Under 37 CFR 1.97 and 37 CFR 1.98.

Powders or particles can be classified into two fractions by particle size in suspension in air, using dynamic separators. To separate the particles according to their size these separators use the forces created by the movement of the air and by the rotary separation members.

The most recent generation of separators is commonly referred to as the "third generation". Starting from a raw product with the same particle size, these separators are able to extract more fines, in a chosen particle size range, than devices of the earlier generations.

They are provided with one or more rotors of vertical axis, fitted at their periphery with fixed selection blades, generally radial. These selection rotors, or cages, are also referred to as "squirrel cages". The materials to be separated are powders, often of mineral origin, such as cement, lime or limestone, the particle size distribution of which may range from a few microns to a few millimeters.

The principles behind the operation of this family of separators are described, amongst others, in documents U.S. Pat. No. 4,551,241 and EP 0 023 320.

In third-generation devices like the one depicted schematically in cross section in FIG. 1, the particles are separated in a confined annular volume referred to as the "selection chamber" 3 delimited, on the outside, by the fixed vanes or louvers 5 that guide the selection air 4 and, on the inside, by the blades of the selection rotor 6. The rotor 6 is secured to a vertical shaft 8 which turns it.

The material to be selected is generally fed under gravity through several feed chutes 1 which are distributed at the upper part of the selection chamber 3. The material leaving the chutes then drops onto an annular distribution plate 2 which spins it to distribute it uniformly in the selection chamber 3. There are also separators in which the material to be classified is conveyed, to the selection chamber in suspension in the air 4, through the guide vanes 5.

Each particle entering the selection chamber 3 is subjected to the resultant of the force of gravity, centrifugal force initiated by the rotation of the turbine 6 and the drag of the selection air 4 introduced through the vanes 5. The lightest particles, referred to as the fines, enter the selection chamber 7 where they are carried by the air toward the outlet duct 9. The heaviest particles, referred to as the tails, drop under gravity into the tails chamber 10 from where they are removed, under gravity, through the tails outlet 11.

The quality of the separation is quantified by parameters taken from a curve known as the Tromp curve, which, for a given particle size fraction, indicates the quantities of tines trapped in the tails.

The cutoff point is the dimension at which any particle below this size is classified as tines and any particle above this size is classified as tails. The desired cutoff point is obtained by varying the rotational speed of the selection rotor. What happens is that increasing this rotational speed increases the centrifugal force component and therefore allows smaller particles to use centrifugal force to compensate for the drag force giving them time to drop under gravity into the tails chamber 10. This therefore reduces the cutoff diameter.

According to industry experience acquired on third-generation separators, the separation quality changes non-linearly in inverse proportion to the selection chamber concentration criterion that measures the ratio between the amount of material fed to the chamber and the flow rate of air passing through it. In other words, as the mass of particles per cubic meter of air increases, so the separation quality drops. As a result, any increase in the quality of cut can be achieved only by an appreciable reduction in this concentration. For a given flow rate of material, this reduction entails increasing the amount of air passing through the separator and therefore the volume of the selection chamber, and this increases the size of the separator and the energy consumption thereof, often undermining the profitability of the investment in relation to the commercial value of the product that is to be classified. Now, by design, a third-generator separator has only two adjustable parameters, these being the rotational speed of the rotor and, within a restricted range generally representing 10% of its nominal value, the ventilation air flow rate.

Document EP0 250 747 discloses a separator having a first separation volume, from which the tines leave directly to the outlet. The tails are conveyed to a second separation volume situated underneath, and this improves the quality of separation of the coarse tails as more fines can be removed from them. Nonetheless, this solution does not make it possible to reduce the air how rate required, but on the contrary requires this flow rate to be increased in order to feed the two separation volumes. It does not therefore allow a significant improvement in the quality of cut for a given ratio of particle mass flow rate to air volume, Document EP0 492 062 discloses a separator with two concentric separation volumes seeking to allow the production of at least three streams of material of different dimensions, with a separation quality that is improved, although nevertheless insufficient. Such a solution does not allow a reduction in the amount of air.

Document DD 241 869 discloses a separator with two concentric separation volumes with rotors rotating in opposite directions to one another to generate a greater difference in speed and increase the flow rate of material processed with the same dimension of device. Nonetheless, such a solution does not allow an improvement in separation quality.

SUMMARY OF THE INVENTION

The present invention proposes a solution that makes it possible to avoid at least some of the aforementioned disadvantages and relates to a separator the internal layout of the classification members of which allows the selection to be broken down, leading to an appreciable reduction in the final concentration levels, without an increase in the volume of air required.

By comparison with a third-generation separator this results either in a gain in the quantity of fines produced or, for the same quantity of fines, in a reduction in the quantity of air required, or even a compromise between the two.

To this end, the invention proposes a dynamic separator for pulverulent materials, such as cement, lime or raw materials, comprising a primary rotor able to rotate about a vertical axis, provided with primary selection blades arranged at its periphery so that as the primary rotor rotates they sweep a hollow circular cylinder, a secondary rotor provided with secondary selection blades arranged at its periphery, some of said secondary selection blades being situated inside said cylinder so as to form a secondary selection chamber between said primary selection blades and said secondary selection blades, and guide vanes situated outside said cylinder so as to form a primary selection chamber between said guide vanes and said primary selection blades. This dynamic separator is unique in that said secondary selection blades and said guide vanes protrude beyond the bottom of said cylinder so as to form, under said cylinder, between said guide vanes and said secondary selection blades, a tails selection chamber intended to cause the tails coming from the primary and secondary selection chambers to undergo an additional separation operation. In this way, the secondary selection chamber recovers an air that has been rid of some of the tails, and therefore has a lower material concentration. For a given air flow rate that makes it possible to obtain improved performance in terms of separation quality. In addition, the tails selection chamber allows the creation of a second stream of fines, and an improvement in the overall fines production flow rate.

According to other features:

- the secondary rotor may comprise an orifice plate arranged substantially level with the lower end of the selection blades of said primary rotor so as to limit the movements of air between a lower part situated under said orifice plate and an upper part situated above said orifice plate of the secondary rotor; this arrangement makes it possible to regulate the relative stream of air between the stream passing through both the primary and secondary selection chambers and the stream passing through the tails selection chamber; that makes it possible to prevent the majority of air from passing through the tails selection chamber as that would reduce the overall performance by reducing the selection operation of the primary and secondary selection chambers,
- said guide vanes may be inclined by rotation about their vertical axis so as to direct the incoming air flow and impart a tangential velocity to it; that makes it possible to reduce the loading on the driving shafts of the primary and secondary rotors,
- the height of the selection blades of the primary rotor may be comprised between half and three-quarters of the height of the selection blades of the secondary rotor; such a proportion yields particularly advantageous results.
- at least one of the rotors may be equipped with a means, able to make its rotational speed adjustable, which makes it possible to regulate the cutoff points of each selection chamber until an optimum result is achieved,
- said separator may comprise a distribution plate arranged above the primary and secondary rotors and able to distribute the incoming stream of material under the effect of centrifugal force,
- said separator may comprise a fines outlet situated above the secondary rotor,
- said separator may comprise a fines outlet situated below the secondary rotor.

The invention also relates to a method of dynamic separation by means of a separator according to the invention, fed with a selection gas, for example selection air. This method is unique in that the angular velocity of the primary rotor is less than that of the secondary rotor.

According to other features:

- the fresh material may be fed under gravity and dispersed, under the effect of centrifugal force, by a distribution plate situated above the selection rotors,
- the pulverulent material ma be fed in suspension in the selection gas, through the guide vanes in the region of the primary and secondary selection chambers, a gas free of pulverulent material being introduced via a distribution duct that envelopes the guide vanes in the region of the tail selection chamber,
- said selection gas may be a hot gas so that the pulverulent materials are dried as they pass through said separator.

BRIEF DESCRIPTION OF THE SEVERAL VIEWS OF THE DRAWINGS

The present invention will be better understood from reading the detailed description which follows, given with reference to the attached figures in which.

DETAILED DESCRIPTION OF THE INVENTION

Figure 1:
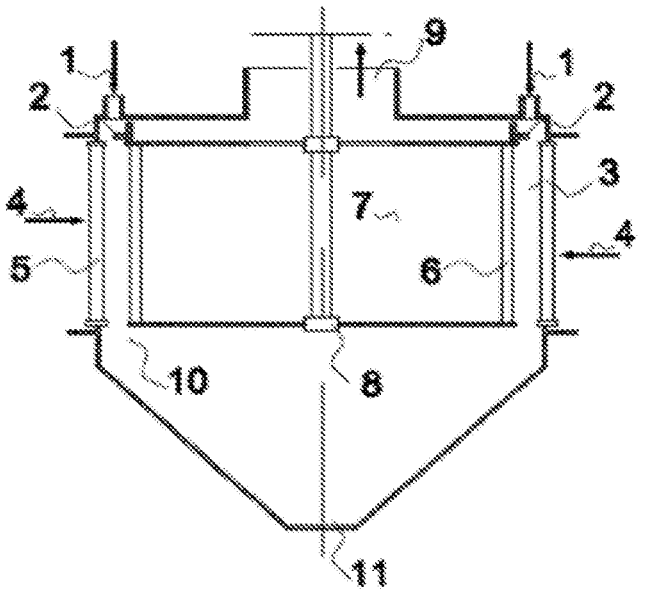
FIG. 1 (PRIOR ART)
FIG. 1 depicts, in cross section, a third-generation separator of the prior art.
Figure 2:
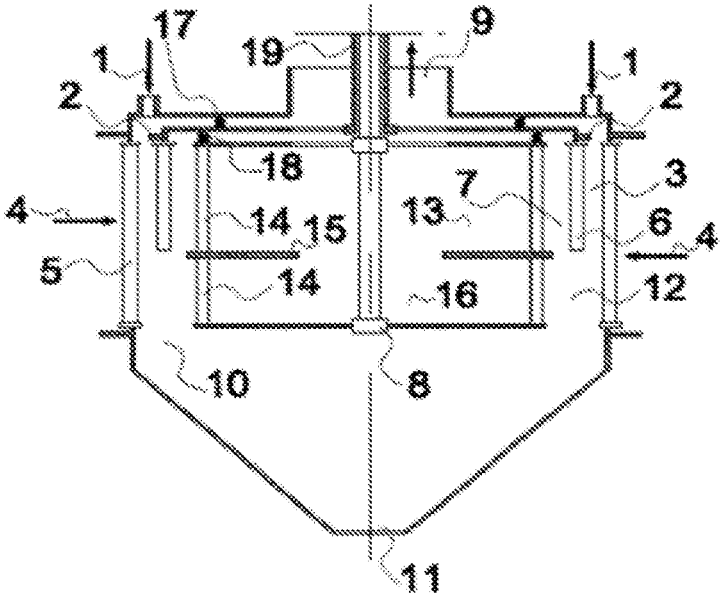
FIG. 2 depicts, in cross section, a separator according to a first embodiment of the invention.

The separator according to the invention is illustrated, in one of the possible configurations, by FIG. 2. It comprises a primary rotor 6 driven by a primary shaft 19 and a secondary rotor 14 coaxial with the primary rotor 6 and driven by a secondary shaft 8. The selection blades of the primary rotor 6 define a cylinder that they sweep as the rotor turns. The annular volume formed by the space between the guide vanes 5 and the selection blades of the primary rotor 6 forms the primary selection chamber 3. The contiguous annular space delimited by the selection blades of the primary rotor 6 and of the secondary rotor 14 constitutes the secondary selection chamber 7, the secondary selection blades being arranged at least in the case of some of them inside the abovementioned cylinder. They are arranged at a distance that is closer to the axis than the selection blades of the primary rotor 6 and describe a cylinder of smaller radius inside the cylinder corresponding to the selection blades of the primary rotor 6. A seal 18 prevents air in the secondary selection chamber 7 from passing directly into the outlet duct 9 without passing via the selection blades of the secondary rotor 14.

According to the invention, the primary rotor 6 rotates at a lower speed than the secondary rotor 14, and this speed may, depending on the application, be fixed or variable for the purposes of optimizing the setting. The selection air 4 enters the separator via the guide vanes 5 with a radial velocity towards the axis of rotation of the rotors. Because of the rotation of the primary rotor 6, the selection air 4 adopts a tangential velocity in addition to its radial velocity. Suitable inclination of the guide vanes 5 imparts this tangential velocity. As a result, particles suspended in the selection air 4 are carried by the airstream toward the inside of the primary rotor 6 and, and in a rotational movement inducing a centrifugal force. Now the centrifugal force applied to a particle increases in proportion with its volume, and therefore more or less with the cube of its dimension, whereas its drag in the air flow increases in proportion with its area, and therefore more or less with the square of its dimension. As a result, the smaller particles will travel further toward the inside of the rotor and the larger particles that are more sensitive to centrifugal force, will spend longer in the annular space formed by the selection chamber and will more often ultimately drop into the fines chamber 10.

The low speed of the primary rotor 6, caused by the lower centrifugal force, subjects the particles passing through the primary rotor 6 to a coarse cutoff point. The result of this is that a first quantity of tails is removed under gravity, this quantity thus being subtracted from the initial quantity of material suspended in the air 4. The selection air 4 reaches the secondary selection chamber 7 containing a lower quantity of material and the selection work is therefore performed on a more weakly concentrated product. Because the rotational speed of the secondary rotor 14 is higher, the centrifugal force increases and the cutoff size is smaller, allowing a stream of fines 20 to be conveyed toward the outlet duct 9 which fines are sufficiently fine because of the lower cutoff, and have very good quality because of the lower concentration of particles in the secondary selection chamber 7.

Moreover, according, to the invention, the height of the selection blades of the primary rotor 6 is comprised between half and three-quarters of the height of the selection blades of the secondary rotor 14. This results in the creation of a tails selection chamber 12 in the lower part of the secondary rotor 14, which chamber collects the tails from the primary 3 and secondary 7 selection chambers. The tails reaching this space are once again selected at an even lower concentration resulting from the respective removal of the fines fractions in the primary 3 and secondary 7 selection chambers. This tails selection chamber 12 operates at the rotational speed of the secondary rotor 14 and therefore with a cutoff point that is the same as that of the secondary selection chamber 7. The quality of cut is very good here also, because of the low concentration of material. The tails selection chamber 12 therefore allows a second stream of fines to be conveyed, toward the outlet duct 9 which stream joins the first stream of fines described hereinabove.

The secondary rotor 14 is partitioned, in its lower part, by an orifice plate 15 which compensates for the smaller pressure drop experienced by the fraction of air passing through the tails selection chamber 12 by comparison with the fraction that passes both through the primary and secondary rotors. Without this orifice plate 15 most of the incoming air would pass through the tails selection chamber 12 where separation would be performed extremely well, but very little air would enter the primary and secondary selection chambers where there would therefore be markedly poorer separation. The orifice plate 15 therefore makes it possible to regulate the distribution of the stream of selection air 4 between the upper part and the lower part of the secondary rotor 14. This orifice plate 15 cuts the secondary rotor 14 into two parts, in the heightwise direction. The upper part 13 receives the fines originating from the primary 3 and secondary 7 selection chambers, whereas the lower part 16 receives the residual fines collected, in the tails selection chamber 12.

In the separator according to the invention, the selection air 4 laden with fines leaves the upper part of the secondary rotor 14 via the outlet duct 9. A circular seal 17 prevents particles fed by the chutes 1 from being sucked out by the air leaving via the duct 9. There may be an arrangement, not depicted in a figure, in which this air leaves via a duct positioned at the base of the secondary rotor 14.

EXAMPLE 1

Class 32.5 Containing 85% Undersize at 32 μm

The separator is fed at 100 t/h with material to be separated, at a rate of 2.5 kg/m$^3$ of air.

This stream enters the primary selection chamber 3. 51.5 t/h of primary fines, with a cut size of 80 μm, pass through the blades of the primary rotor 6 and reach the secondary chamber. The remaining 48.5 t/h drop directly into the tails selection chamber 12. The primary lines therefore enter the secondary selection chamber 7 at a concentration reduced to 1.29 kg/m$^3$, winch makes it possible to obtain 24.1 t/h passing through the blades of the secondary rotor 14, cut at 28 μm, which can leave the separator via the duct 9 as finished product. The secondary tails represent 27.4 t/h and are added to the 48.5 t/h of primary tails to give a flow rate of 75.9 t/h which enters the tails selection chamber 12, with a concentration of 1.9 kg, m$^3$. This concentration allows the recovery of 13 t/h of fines cut at 28 μm which are added to the 24.1 t/h giving a production of 37.1 t/h leaving via the duct 9 as finished product.

An installation according to the prior art, likewise fed with such a product at 100 t/h at a concentration of 2.5 kg/m$^3$ makes it possible to achieve a production of 33.75 t/h of fines cut at 23 μm. An increase in production of around 10% can therefore be seen, with the separator according to the invention yielding a liner product.

EXAMPLE 2

Cement Class 52.5 Containing 93% Undersize at 32 μm

The separator is fed at 100 t/h with material to be separated, at a rate of 2.5 kg/m$^3$ of air.

This stream enters the primary selection chamber 3. 51.5 t/h of primary fines, with a cut size of 80 μm, pass through the blades of the primary rotor to and reach the secondary chamber. The remaining 48.5 t/h drop directly into the tails selection chamber 12. The primary fines therefore enter the secondary selection chamber 7 at a concentration reduced to 1.29 kg/m$^3$, which makes it possible to obtain 19.9 t/h passing through the blades of the secondary rotor 14, cut at 22 μm, which can leave the separator via the duct 9 as finished product. The secondary tails represent 31.6 t/h and are added to the 48.5 t/h of primary tails to give a flow rate of 80.1 t/h at which enters the tails selection chamber 12, with a concentration of 2.0 kg/m$^3$. This concentration allows the recovery of 11.6 t/h of fines cut at 22 μm which are added to the 19.9 t/h giving a production of 31.5 t/h leaving via the duct 9 as finished product.

An installation according to the prior art, likewise fed with such a product at 100 t/h at a concentration of 2.5 kg/m$^3$ makes it possible to achieve a production of 27.4 t/h of tines cut at 23 μm. An increase in production of around 15% can therefore be seen, with the separator according to the invention yielding a finer product.

The material to be selected is fed under gravity through the feed chutes 1 distributed about the periphery of the primary selection chamber 3. The number of these chutes depends on the size of the separator and on the flow rate being processed; it is generally greater than or equal to two in order to ensure the most even possible distribution.

A distribution plate 2, driven by the primary rotor 6 then distributes this material throughout the annular space corresponding to the upper part of the primary selection chamber 3. The material thus dispersed drops into the primary selection chamber 3 where each of the particles is subjected to the triple effect of centrifugal force generated by the rotation of the primary rotor 6, antagonistic. thrust of the selection air 4, and gravity. A high proportion of the particles of a size above the primary cutoff point defined by the rotation speed of the primary rotor 6 therefore drops into the tails selection chamber 12; whereas the greater proportion of the particles of a size smaller than or equal to the primary cutoff point is carried into the secondary selection chamber 7. According to the invention, this results in an appreciable reduction in the material concentration in this chamber, caused by a fraction of the coarsest elements being withdrawn during the primary selection. The secondary rotor 14, rotating at a speed higher than that of the primary rotor 6, increasing the centrifugal force, gives rise to a smaller size cutoff point than that created by the primary rotor 6. This results in the removal of a second quantity of tails which in turn drop into the tails selection chamber 12. The secondary rotor 14 is provided, with a speed varying device which allows the final cutoff point to be adjusted according to the desired particle size distribution curve for the finished product. In the tails selection chamber 12 all of the tails undergo a third selection with a view to extracting from them any residual fines that have been trapped in the tails during the previous two selections. The blades of the secondary rotor 14 extend into the tails selection chamber 12 and are active therein in collaboration with the vanes. The blades may be straight and rotate with the secondary rotor 14 on the same diameter in this zone as in the secondary selection chamber 7. However, they may equally be situated further from the axis of the rotors, or closer, depending on the separator design requirements, it also being possible for these blades to be blades independent of those which are active in the secondary selection chamber 7 but fixed to the same secondary rotor 14. As the concentration levels in the two selection chambers 7 and 12 are appreciably lower than the initial concentration in the chamber 3, the fines recovery rates are higher than those of a third-generation separator with an equivalent selection air flow rate 4 and a rotor rotating at the same speed as the secondary rotor 14 of the separator according to the invention (see examples above).

According to an alternative form of the invention, the separator may have no tails selection chamber 12. It then enjoys the advantage of the lower concentration in the secondary selection chamber 7. Nevertheless, the results obtained for a given material concentration are generally not as good, because the advantage of the third chamber to recover an additional stream of fines is not enjoyed.

Figure 4:
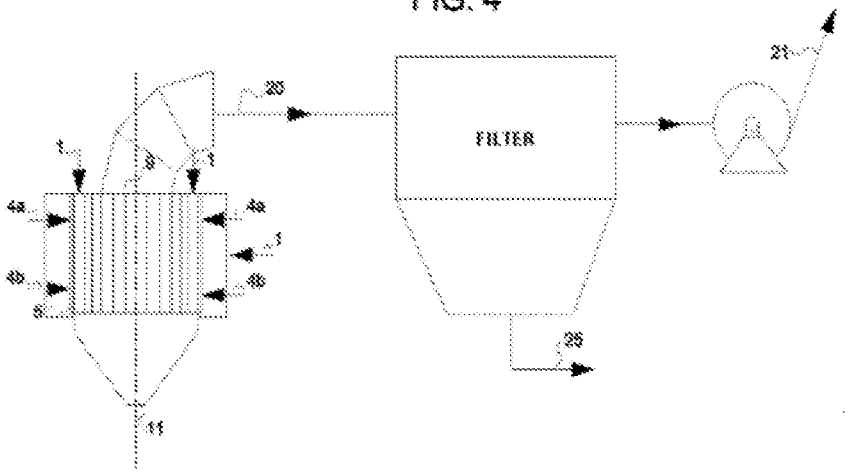
FIG. 4 depicts one of the possible arrangements for the aeraulic classification diagram for a separator gravity-fed with material according to FIG. 2.

The separator according to the invention can be fed under gravity in a way common to third-generation separators, from feed chutes 1 feeding a distribution plate 2. In this configuration, FIG. 4 shows an example of an aeraulic diagram in which the air laden with fines 20 is introduced into a filter for separating these fines and recovering 25 them under the filter housing, while the purified air 21 is removed by a fan.

Figure 3:
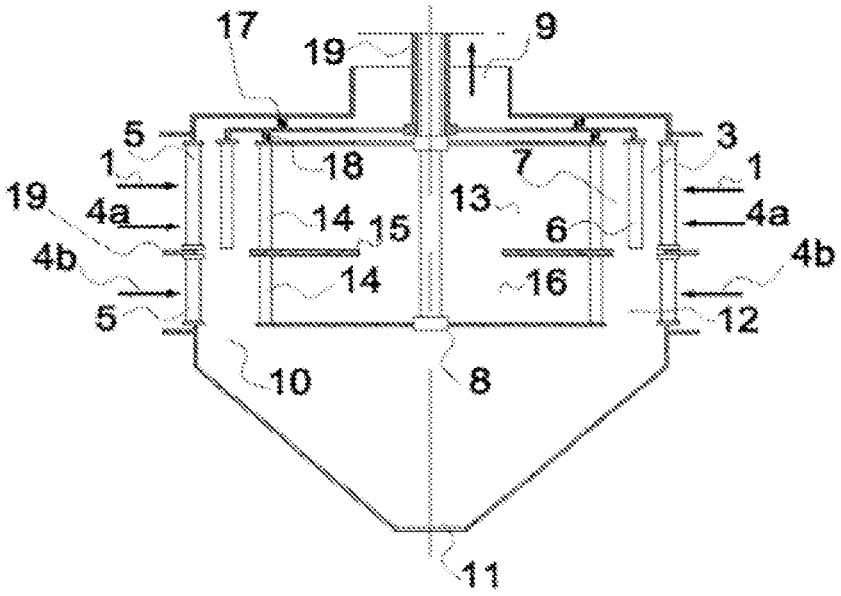
FIG. 3 depicts, in cross section, a separator according to a second embodiment of the invention.
Figure 5:
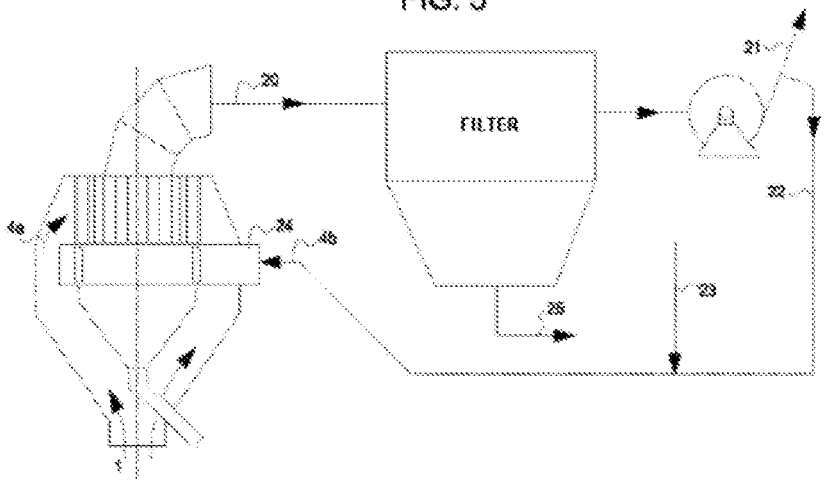
FIG. 5 depicts one of the possible arrangements of the aeraulic classification diagram for a separator fed with material pneumatically, according to FIG. 3.

The invention discloses another alternative form, illustrated by FIGS. 3 and 5. In this alternative form, the material 1 to be selected is brought in suspension in the primary fraction 4*a* of the selection air 4, which fraction is fed exclusively into the selection chambers 3 and 7. The remainder of the selection air 4, which constitutes the secondary fraction 4*b* and enters the tails selection chamber 12, is free of suspended material, thus making it possible, in this zone, to avoid raising, the concentration levels. The airstreams are separated at the rotors according to the principle illustrated in FIG. 5 in which the secondary fraction 4*b* of the air arrives through an air distribution duct 24 which distributes it through the lower pan of the guide vanes 5. In the example of FIG. 5, the secondary fraction 4*b* of the air comes from recirculating 22 a fraction of the purified air 21. An injection point 23 makes it possible, if need be, to control the temperature of the secondary fraction 4*b* of the air by using the injection point 23 to introduce an air or a gas at a set temperature.

The separator according to the invention makes it possible to adjust the ratio of the speeds of the primary and secondary IDIOTS so as to minimize the concentration levels in the selection chambers, for a constant air flow rate.

Whatever the configuration of the material feed, the selection air 4 may be replaced by a hot combustion gas that allows the material to be dried during the classification phases.

The two commonest problems presented by most third-generation separators are the difficulty with balancing the incoming streams between the feed chutes 1, in cases where the feed is a gravity feed system, and the angular orientation of the fines outlet duct 9 in the vertical plane.

Regarding the problem of the gravity feed of the material inlet 1, the separator according to the invention proposes a single feed point for fresh material 1, preferably located axially, and takes the initiative of optimizing this distribution using the distribution plate 2 in a way that is transparent to the installer.

As far as the orientation of the outlet duct 9 is concerned, this may be oriented in the standard way, in a vertical plane, in steps of 15 degrees, between 45 and 90 degrees, according to the installer's wishes.

For the air inlet 4 to the separator in gravity feed mode, the installer has the choice between an annular inlet, from beneath, or a cyclone side inlet.

This flexibility makes the separator far easier to install, particularly in existing workshops where there may be tight constraints on installation.

The present invention is particularly intended for the classification of powders such as those produced in industrial grinding facilities of all capacities, and over a wide range of finenesses, that may range from a few microns to a few mm.

Although the invention has been described according, to one particular embodiment, it is not in any way restricted thereto and variations can be made to it, as well as combinations of the variants described, without thereby departing from the scope of the present invention.

PARTS LIST

1 Material inlet
2 Distribution plate
3 Primary selection chamber
4 Incoming air
5 Guide vane
6 Primary rotor
7 Secondary selection chamber
8 Secondary shaft
9 Outlet duct
10 Tails chamber
11 Outlet orifice
12 Tails selection chamber
13 Upper part of the secondary rotor
14 Secondary rotor
15 Orifice plate
16 Lower part of the secondary rotor
17 Seal
18 Seal
19 Primary shaft
20 Air laden with fines
21 Purified air
22 Recirculation of pan of the purified aft
23 Injection point
24 Air distribution duct
25 Fines collection

The invention claimed is:

1. A dynamic separator apparatus for pulverulent material, the dynamic separator apparatus comprising:

a primary rotor rotatable about a vertical axis, said primary rotor having a primary selection blades arranged at a periphery thereof such that as said primary rotor rotates said primary selection blades sweep in a hollow circular cylindrical shape;

a secondary rotor having secondary selection blades at a periphery thereof, a number of said secondary selection blades being situated within the hollow circular cylindrical shape so as to define a secondary selection chamber between said primary selection blades; and a plurality of guide vanes positioned outside of the hollow circular cylindrical shape so as to define a primary selection chamber between said plurality of guide vanes and said primary selection blades, said secondary selection vanes and said plurality of guide vanes protruding beyond a bottom of and below the hollow circular cylindrical shape so as to define a tails selection chamber between said plurality of guide vanes and said secondary selection blades such that tails coming from the primary and secondary selection chambers are further separated.

2. The dynamic separator apparatus of claim 1, said secondary rotor comprising an orifice plate arranged substantially level with a lower end of said primary selection blades so as to limit air movement between a lower part positioned under said orifice plate and an upper part positioned above said orifice plate.

3. The dynamic separator apparatus of claim 1, wherein said plurality of guide vanes are inclined by rotation about a vertical axis so as to direct an incoming air flow and to impart a tangential velocity to the incoming air flow.

4. The dynamic separator apparatus of claim 1, said primary selection blades having a height that is between one-half and three-quarters of a height of said secondary selection blades.

5. The dynamic separator apparatus of claim 1, further comprising:

a rotational speed variator connected to at least one of said primary rotor and said secondary rotor so as to adjust a rotation speed of the rotor.

6. The dynamic separator apparatus of claim 5, said rotation speed variator being a frequency variator.

7. The dynamic separator apparatus of claim 1, further comprising:

a distribution plate positioned above said primary rotor and said secondary rotor so as to distribute an incoming stream of the material with a centrifugal force.

8. The dynamic separator apparatus of claim 1, further comprising:

a fines outlet positioned above said secondary rotor.

9. The dynamic separator apparatus of claim 1, further comprising:

a fines outlet positioned below said secondary rotor.

10. A method of dynamic separation by the dynamic separator apparatus of claim 1, the method comprising:

feeding a selection gas to the dynamic separator apparatus; and setting an angular velocity of said primary rotor that is less than an angular velocity of said secondary rotor.

11. The method of claim 10, further comprising:

feeding the pulverulent materials by gravity; and centrifugally dispersing the pulverulent material by a distribution plate positioned above said primary rotor and said secondary rotor.

12. The method of claim 10, further comprising:

drying the pulverulent material with a hot gas as the pulverulent material passes through the dynamic separator apparatus.

* * * * *